US008556131B2

(12) United States Patent
Decottignies et al.

(10) Patent No.: US 8,556,131 B2
(45) Date of Patent: Oct. 15, 2013

(54) FLUID DISPENSER

(75) Inventors: Laurent Decottignies, Cergy (FR); Alain Behar, Suresnes (FR)

(73) Assignee: Aptar France SAS, Le Neubourg (FR)

( * ) Notice: Subject to any disclaimer, the term of this patent is extended or adjusted under 35 U.S.C. 154(b) by 425 days.

(21) Appl. No.: 12/307,062

(22) PCT Filed: Jul. 2, 2007

(86) PCT No.: PCT/FR2007/051572
§ 371 (c)(1),
(2), (4) Date: Dec. 30, 2008

(87) PCT Pub. No.: WO2008/003894
PCT Pub. Date: Jan. 10, 2008

(65) Prior Publication Data

US 2009/0230152 A1 Sep. 17, 2009

(30) Foreign Application Priority Data

Jul. 3, 2006 (FR) ..... 06 52780

(51) Int. Cl.
*G01F 11/00* (2006.01)

(52) U.S. Cl.
USPC ..... 222/319; 222/256; 222/386; 222/405

(58) Field of Classification Search
USPC ..... 222/207, 633, 632, 386, 319, 260, 402, 222/256, 387, 280, 405, 214
See application file for complete search history.

(56) References Cited

U.S. PATENT DOCUMENTS

| | | | | | |
|---|---|---|---|---|---|
| 2,443,981 | A * | 6/1948 | Funk et al. | ..... | 222/259 |
| 2,898,007 | A * | 8/1959 | Gassaway | ..... | 222/212 |
| 4,175,704 | A * | 11/1979 | Cohen | ..... | 239/320 |
| 4,205,766 | A * | 6/1980 | White | ..... | 222/135 |
| 4,533,069 | A * | 8/1985 | Drobish | ..... | 222/209 |
| 5,020,930 | A * | 6/1991 | Kuhn | ..... | 401/146 |
| 5,257,726 | A * | 11/1993 | Graf et al. | ..... | 222/320 |
| 6,070,763 | A * | 6/2000 | Gueret | ..... | 222/95 |
| 6,341,718 | B1 * | 1/2002 | Schilthuizen et al. | ..... | 222/207 |
| 6,406,207 | B1 * | 6/2002 | Wiegner et al. | ..... | 401/272 |
| 2006/0196889 | A1 * | 9/2006 | Masuda | ..... | 222/256 |

FOREIGN PATENT DOCUMENTS

| | | | |
|---|---|---|---|
| DE | 80 30 266 | U1 | 3/1981 |
| DE | 33 05 898 | A1 | 8/1984 |
| FR | 2 821 831 | A1 | 9/2002 |
| FR | 2 826 245 | A1 | 12/2002 |

* cited by examiner

*Primary Examiner* — Paul R Durand
*Assistant Examiner* — Robert Nichols, II
(74) *Attorney, Agent, or Firm* — Sughrue Mion, PLLC

(57) ABSTRACT

A fluid dispenser comprising: a fluid reservoir (10) of variable working volume, in which reservoir the fluid is protected from the air, the reservoir being provided with an actuator wall (25) that is axially movable down and up between a rest position and a depressed position, the movement of the wall causing the pressure in the reservoir to vary, the wall being situated at an end of the dispenser; and a dispenser orifice (150) via which the fluid is dispensed, the orifice being provided with an outlet valve (4); the dispenser being characterized in that the orifice (150) is situated at an end of the dispenser other than the end at which the actuator wall (25) is situated.

13 Claims, 3 Drawing Sheets

Figure 1:
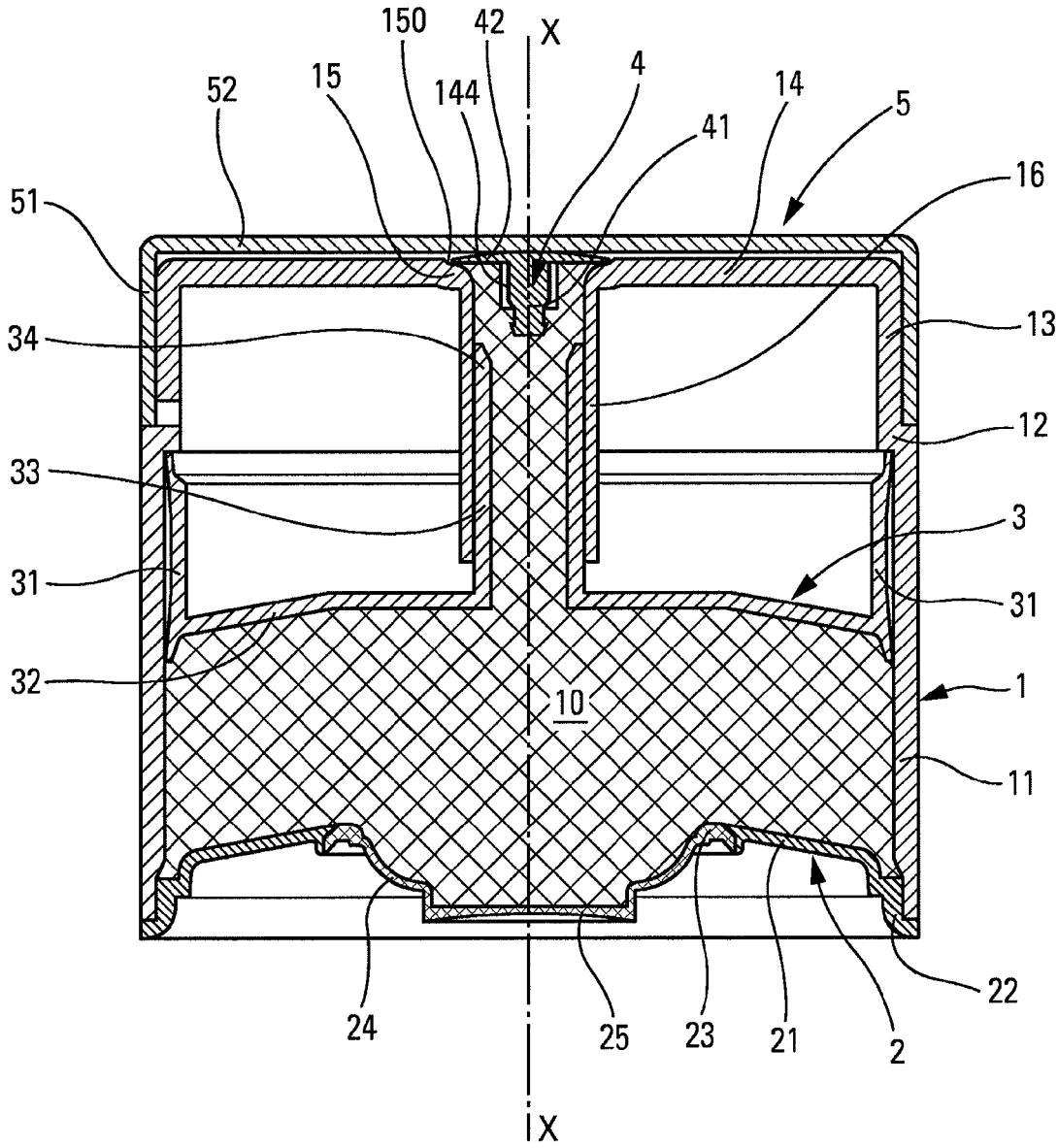

5
150
4
15
33
12
31
3
10
24
25

4
15
16
34
33
3
10
24
25

4
15
16
34
33
31
3
10
24
25

FLUID DISPENSER

The present invention relates to a fluid dispenser for dispensing fluids that are more or less viscous, e.g. cream, gel, paste, lotion, perfume, etc. The dispenser includes a fluid reservoir of variable volume in which the fluid is stored out of contact with the air. The reservoir is provided with an actuator wall that is axially movable down and up between a rest position and a depressed position. The movement of the wall causes the pressure inside the reservoir to vary between suction stages and pressure stages. The wall is situated on one end of the dispenser. In addition, the dispenser includes a dispenser orifice via which the fluid is dispensed out from the dispenser. The orifice is provided with a check valve that prevents air from being sucked into the reservoir. Such dispensers are often encountered in the fields of perfumery, cosmetics, pharmacy, and non-prescription.

In general, in such dispensers, the actuator wall is situated in the proximity of the dispenser orifice so that the depression of the actuator wall causes the fluid stored in the reservoir to be put directly under pressure so that it flows through the dispenser orifice. When the actuator wall is released so that it returns to its rest position, the outlet valve closes: the reservoir is thus subjected to suction, thereby modifying its working volume. By way of example, the working volume can vary as a result of the reservoir being made from a deformable flexible pouch. In a variant, the reservoir forms a slide cylinder in which there is engaged a follower piston. For a flexible pouch, the suction causes the deformation of the flexible pouch that shrivels up. For a follower piston, the suction inside the reservoir moves the follower piston by suction. Either way, the working volume of the reservoir decreases as the fluid is extracted therefrom. As a result, it is not possible to install the actuator wall anywhere on the reservoir, and, in any event, not at the slide cylinder that must not be deformable. The actuator wall also cannot be installed on the follower piston. Thus, it is generally installed on the top of the reservoir in the proximity of the dispenser orifice.

An object of the present invention is to make a dispenser of that type having a configuration that overcomes that design constraint.

To do this, the present invention proposes that the dispenser orifice is situated at an end of the dispenser other than the end at which the actuator wall is situated. The fluid dispenser advantageously includes a bottom and a top when it is positioned upright, the actuator wall being situated at the bottom, with the dispenser bearing, in its rest position and in its depressed position, against the actuator wall. The dispenser can thus be actuated by pressing on the dispenser, while its bottom wall bears against a bearing surface. The fluid is dispensed onto the top or onto a side of the dispenser.

According to another advantageous characteristic of the invention, the reservoir forms a slide cylinder in which there is engaged a follower piston that is slidably mounted in leaktight manner. This is one of the configurations that makes it possible to provide a reservoir of variable volume. However, given that the actuator wall is situated at an end other than the end with the dispenser orifice, the configuration is paradoxal, since it should be observed that the actuator wall does not act directly on the follower piston, but rather on the fluid. Conventionally, the follower piston is at the bottom, and the orifice and the actuator wall at the top. A difficulty surmounted by the present invention is in separating the orifice from the actuator wall, while using a follower piston. To do this, the follower piston can form a connection duct that puts the reservoir into communication with the dispenser orifice. Firstly, it should be observed that this characteristic can be implemented independently of the fact that the actuator wall is distant or separate from the dispenser orifice. However, the combination of these two characteristics is advantageous. Conventionally, the follower piston does not communicate directly with the dispenser orifice. The follower piston is generally situated at the bottom of the reservoir, and it moves towards the dispenser orifice by suction. The originality of this characteristic resides in the fact that the follower piston connects the reservoir to the dispenser orifice.

The wall and the follower piston advantageously move along a common axis X. They are separated by the fluid stored in the reservoir. Each time the wall is depressed, fluid is dispensed and the follower piston remains static, and each time the wall is released, the follower piston moves.

Advantageously, the duct is slidably engaged in leaktight manner in a sleeve that is secured to the dispenser orifice, the duct and the sleeve sliding relative to each other as the follower piston moves in the cylinder. Naturally, as in any conventional dispenser having a follower piston, said follower piston should be able to move relative to the dispenser orifice. In this embodiment, movement is possible by means of the sliding leaktight engagement between the follower piston and the dispenser orifice. In a practical embodiment, the cylinder, the sleeve, and the dispenser orifice are formed by a one-piece body. The body preferably includes a top plate that forms the top of the dispenser, the plate being formed with a hole that is advantageously provided with an outlet valve, said hole and said outlet valve co-operating with each other to form the dispenser orifice. It should thus be observed that, if the outlet valve is omitted, the dispenser can be made from only three parts, namely the one-piece body, the follower piston, and the actuator wall.

In another aspect of the invention, the dispenser can include a one-piece body that internally defines the fluid reservoir, the body being closed by a bottom wall that forms the actuator wall. Advantageously, the reservoir is mainly formed by the bottom wall, the body, and a follower piston, the follower piston being positioned between the bottom wall and the dispenser orifice. The body advantageously forms a sleeve that is secured to the dispenser orifice, the follower piston forming a duct that is slidably engaged in leaktight manner in the sleeve, the reservoir thus communicating with the dispenser orifice via the duct and the sleeve.

The original configuration of the dispenser of the invention, namely having the actuator wall distant or separate from the dispenser orifice, is made possible in this embodiment by using a follower piston that connects the reservoir to the dispenser orifice. However, this latter characteristic is protectable on its own.

The invention is described more fully below with reference to the accompanying drawings that show two embodiments of the invention by way of non-limiting example.

Figures 2A, 2B, 2C:
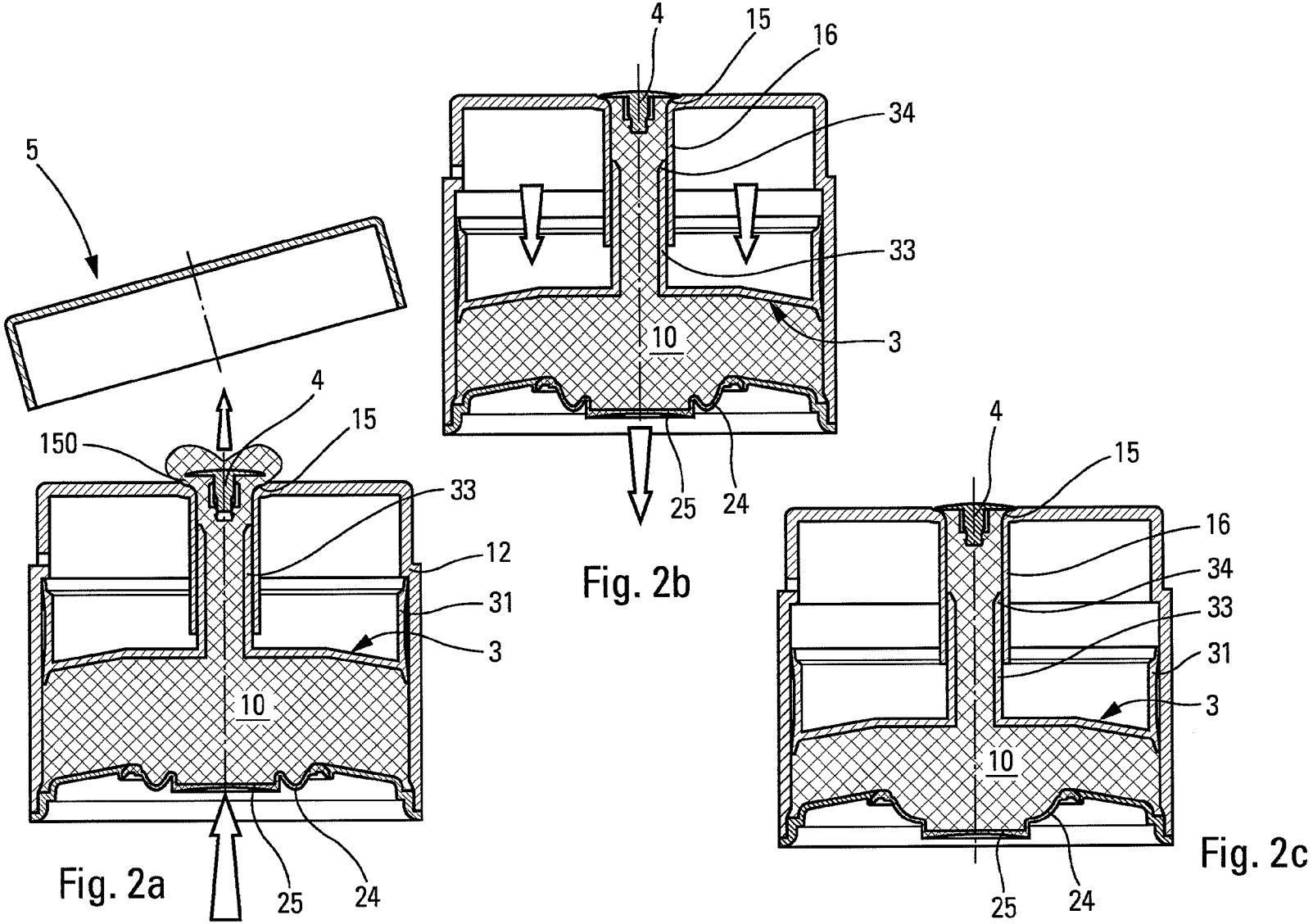
Figure 4:
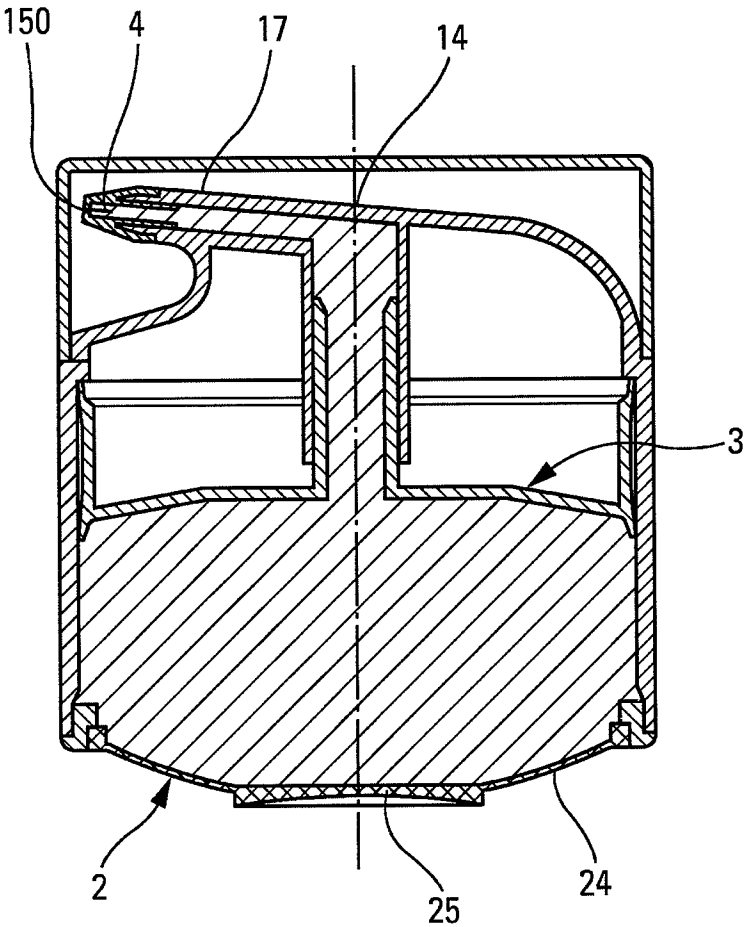
Figure 3:
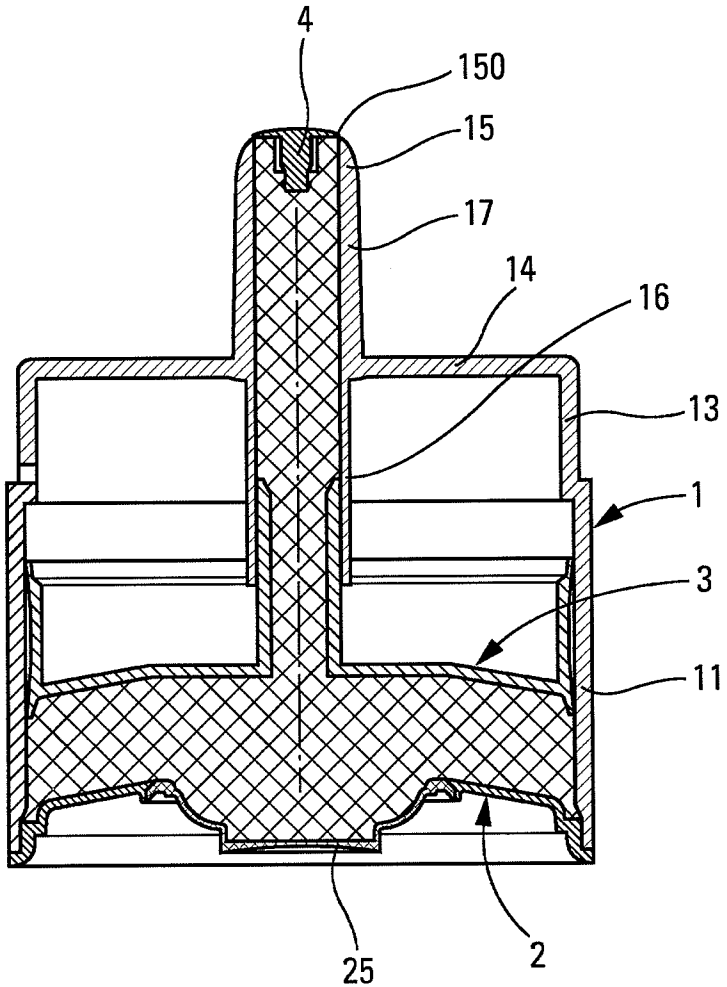

In the figures:

FIG. 1 is a vertical-section view through a fluid dispenser of the invention, in its rest state;

FIGS. 2*a*, 2*b*, and 2*c* show the FIG. 1 dispenser during various stages of the operating cycle of the dispenser;

FIG. 3 is a view similar to the view in FIG. 1 for a variant embodiment of the invention; and FIG. 4 is a view similar to the view in FIG. 3 for another variant embodiment of the invention.

The fluid dispenser of the invention essentially comprises three component parts, namely a body, a bottom wall 2, and a follower piston 3. The dispenser also comprises an outlet valve 4 or a nozzle fitting. Furthermore, the dispenser may also be provided with a protective cap 5 that is mounted in removable manner on the dispenser in such a manner as to mask its dispenser orifice.

The body 1 is preferably made as a single part made of plastics material, and includes a cylinder 11 that is advantageously circularly cylindrical, and inside which the follower piston 3 slides, as described below. The cylinder 11 includes an open bottom end, and a top end that forms an inwardly-directed shoulder 12. The body 1 extends upwards from the shoulder 12 so as to form a ring 13 that can advantageously serve to fasten the protective cap 5. Beyond the ring 13, the body 1 forms a plate 14 that is substantially circular in this embodiment. The plate 14 is substantially plane or concave and includes a substantially central hole that serves to define the dispenser orifice. A sleeve 16 extends from the hole towards the inside of the body such that the ring 13 extends coaxially with the sleeve 16. The bottom end of the sleeve 16 extends as far as the cylinder 11. At the substantially central hole, the plate 14 optionally defines a fastener structure 144 that makes it possible to retain the valve 4. Although it is possible to use any outlet valve in the context of the present invention, it is possible for example to use a valve in the shape of a mushroom or of a parasol comprising an anchor foot 41 that is engaged in the fastener structure 144, and a washer or a disk 42 having an edge that selectively comes to bear in leaktight manner against a valve seat 15 that is formed at the junction of the plate 14 with the sleeve 16 that defines the hole. The foot 41 can be fastened into place inside the fastener structure 144: in this event, the washer 42 is elastically deformable. In a variant, the anchor foot 41 can move over a limited stroke inside the fastener structure 144: in this event, the washer 42 does not need to be elastically deformable. Instead of this particular valve, naturally it is possible to use another type of valve or even a shutter, e.g. a slotted shutter. It is even possible to envisage not having a valve, such that the hole defines the dispenser orifice.

The protective cap 5 comprises: a peripheral skirt 51 for coming into friction, snap-fastening, or screw-fastening engagement with the ring 13; and a covering wall 52 that comes to cover the plate 14 together with its central hole and its valve 4. The protective cap 5 can be removed completely from the body 1, or, in a variant, the cap can be hinged onto the body. It is also possible to imagine that the cap 5 is made integrally with the body and is connected thereto by a bridge of deformable material.

In conventional manner, the follower piston 3 includes a sealing lip 31 that is of the type having leaktight dual sliding contact in this embodiment. The sealing lip 31 is connected to a roof 32 that is extended at its center by an axial duct 33 that is open at both ends. The duct 33 includes a free end that is remote from the roof 32 and that forms a leaktight sliding lip 34. The duct 33 is engaged inside the sleeve 16 such that the lip 34 can slide in leaktight manner inside the sleeve 16. It is also possible to envisage that the duct 33 is disposed around the sleeve 16: in this event, it is the free end of the sleeve 16 that is thus provided with a sealing lip. The sealing lip 31 of the follower piston is slidably engaged in leaktight manner inside the cylinder 11 of the body 1. In the initial start position, the lip 31 is situated in the top portion of the cylinder 11. As the dispenser is used, the lip 31 moves towards the bottom of the cylinder 11.

In addition, the bottom wall 2 of the dispenser is engaged in leaktight manner in the open bottom end of the cylinder 11. The bottom wall 2 comprises a rigid annular dish 21 that, at its outer periphery 22, is anchored in leaktight manner in the cylinder 11. The inner periphery of the dish 21 is connected to a membrane 24 that presents a fastener heel connected to the dish. The elastically-deformable membrane 24 is in the form of an annular dome that is closed at its center by an actuator wall 25. The wall 25 is situated in substantially central manner relative to the bottom wall 2 of the dispenser. The actuator wall 25 is axially movable down and up by deforming the flexible membrane 24. In FIG. 1, the actuator wall 25 is in its rest position. From this position, it is possible to move the wall until it reaches a maximum depressed position, shown in FIG. 2*a*. The bottom wall 2 can be made as a single part with a single plastics material. In a variant, the bottom wall 2 can be made by dual-injecting or co-molding two different plastics materials.

It should be observed that the bottom wall, and consequently the actuator wall, are in direct contact with the fluid, such that they form a wall element of the reservoir.

With reference once again to FIG. 1, it can be seen that the bottom wall 2, a portion of the cylinder 11, and the roof 32 of the follower piston co-operate with one another to form a variable working volume that serves as a reservoir 10 for the fluid. The reservoir communicates with the outlet valve 4 via the connection duct 33 that is formed by the follower piston 3 that is engaged inside the sleeve 16.

In FIG. 1, the dispenser is in its rest position with the reservoir 10 filled to its maximum, the lip 31 of the follower piston being in abutment against the shoulder 12. The valve 4 is closed such that there is no dispenser orifice. The lip 34 is at its highest point in the sleeve 16. Starting from this initial rest position, a complete operating cycle of the dispenser of the invention is described below with reference to FIGS. 2*a*, 2*b*, and 2*c*. When the dispenser is provided with an optional protective cap 5, the first step consists in removing the cap 5, as shown in FIG. 2*a*. Then, the user can exert pressure, represented by the large arrow in FIG. 2*a*, on the actuator wall 25. This causes the flexible membrane 24 to deform. Consequently, the fluid stored inside the reservoir 10 is put under pressure directly, thereby causing a fraction of the fluid to flow through the duct 33 until it reaches the valve 4 that is thus forced open in such a manner as to define an annular dispenser orifice 150. The orifice is defined between the seat 15 and the washer 144. During this dispensing stage, the follower piston remains static, with its sealing lip 31 in abutment contact with the shoulder 12. The fluid continues to be dispensed until the actuator wall 25 reaches its maximum depressed position. Fluid thus stops being dispensed at this moment, and when the pressure on the actuator wall 25 is released, the valve 4 closes such that once again there is no longer a dispenser orifice 150. The wall 25 thus returns to its initial rest position under the effect of the membrane 24 that tends to return to its initial start position as a result of its elastic shape memory. The membrane 24 thus acts as a return spring in this embodiment. During this return stage to its initial position, the actuator wall 25 generates suction inside the reservoir 10, thereby causing the follower piston 3 to be sucked down, which piston then moves slidably in leaktight manner inside the cylinder. The movement of the follower piston is represented in FIG. 2*b* by the two arrows on either side of the duct 33. Given that the duct 33 is slidably engaged in leaktight manner inside the sleeve 16, the movement of the follower piston in the cylinder 11 also causes the sealing lip 34 to slide inside the sleeve 16. When the actuator wall 25 returns to its initial rest position, as shown in FIG. 2*c*, the follower piston 3 has ended its stroke towards the bottom wall, and the distance between the reservoir 10 and the valve 4 has increased.

It can thus been seen that the follower piston provides a fluid connection between the reservoir 10 and the dispenser orifice. The fluid connection makes it possible to provide an airless dispenser having an actuator wall, movable down and up, that is clearly separate from the dispenser orifice and that is even situated remote therefrom. Furthermore, given that the actuator wall 25 is movable between two extreme positions, fluid dispensing is properly metered. In this way, an airless metering dispenser is obtained that has an actuator wall that is situated at the bottom and a dispenser orifice that is situated at the top. It is the follower piston proper that provides the connection between the reservoir and the dispenser orifice.

Reference is made below to FIG. 3 that shows a variant embodiment in which the follower piston 3 and the bottom wall 2 can be similar or identical to those of the first embodiment. With regard to the body 1, it also comprises a cylinder 11, a ring 13, a plate 14, and a sleeve 16, but it further comprises a dispenser endpiece 17 that is terminated by a dispenser orifice 150. The dispenser also comprises an outlet valve 4. The dispenser orifice 150 can also be made by means of a nozzle that serves to swirl the fluid. The nozzle can be integrated in the body 1 or it can even be made in the form of a separate fitting. The FIG. 3 dispenser comprises three component parts, namely the body 1, the bottom wall 2, and the follower piston 3. The dispenser can be used one-handed like a syringe by disposing the index and middle fingers on the top part of the plate 14 on either side of the endpiece 17, and the thumb on the actuator wall 25. It differs from a conventional syringe in that the fluid dispensing is properly metered and the actuator wall returns to its initial rest position on each actuation. By way of example, such a dispenser can be used in pharmacy to inject various fluids into natural orifices such as the nostrils, or the ears, for example.

In FIG. 4, the dispenser shown differs from the FIG. 3 dispenser essentially at the endpiece 17 and at its bottom wall 2. In this embodiment, the endpiece is no longer axial, but on the contrary it is lateral. The dispenser orifice 150 is formed by a slotted shutter that opens ajar under the pressure of the fluid. In addition, the actuator wall 25 projects downwards and can thus constitute a bearing surface of the dispenser.

Naturally, it is also possible to imagine other embodiments in which the actuator wall is not situated at the bottom of the dispenser, but on the side or on the top. In addition, the follower piston 3 could move horizontally.

By means of the invention a dispenser is provided having fluid that is protected from the air, and that is actuated at a distance from where dispensing takes place.

The invention claimed is:

1. A fluid dispenser comprising:

a fluid reservoir of variable working volume, in which the reservoir fluid is protected from the air, a wall of the reservoir is an actuator wall that is axially movable down and up between a rest position and a depressed position, the movement of the wall causing the pressure in the reservoir to vary, the wall being situated at an end of the dispenser; and a dispenser orifice via which the fluid is dispensed, the orifice being provided with an outlet valve;

the actuator wall is in direct contact with the fluid in the reservoir; and the reservoir forms a slide cylinder in which there is engaged a follower piston that is configured to slide in a leaktight manner in the cylinder, wherein the actuator wall and the follower piston move along a common axis X, and the follower piston remains static with respect to the cylinder during dispensing and moves with respect to the cylinder when the pressure on the actuator wall is released, wherein the orifice is situated at an end of the dispenser other than the end at which the actuator wall is situated, and wherein the follower piston forms a connection duct that puts the reservoir into communication with the dispenser orifice.

2. The fluid dispenser according to claim 1, in which the duct is slidably engaged in leaktight manner in a sleeve that is secured to the dispenser orifice, the duct and the sleeve sliding relative to each other as the follower piston moves in the cylinder.

3. The fluid dispenser according to claim 2, in which the cylinder, the sleeve, and the dispenser orifice are formed by a one-piece body.

4. The fluid dispenser according to claim 3, in which the body includes a top plate forming the top of the dispenser, the plate being formed with a hole that is advantageously provided with an outlet valve, said hole and said outlet valve co-operating with each other to form the dispenser orifice.

5. A fluid dispenser comprising:

a fluid reservoir of variable working volume, in which the reservoir fluid is protected from the air, a wall of the reservoir is an actuator wall that is axially movable down and up between a rest position and a depressed position, the movement of the wall causing the pressure in the reservoir to vary, the wall being situated at an end of the dispenser; and a dispenser orifice via which the fluid is dispensed, the orifice being provided with an outlet valve;

the actuator wall is in direct contact with the fluid in the reservoir; and the reservoir forms a slide cylinder in which there is engaged a follower piston that is configured to slide in a leaktight manner in the cylinder, wherein the actuator wall and the follower piston move along a common axis X, and the follower piston remains static with respect to the cylinder during dispensing and moves with respect to the cylinder when the pressure on the actuator wall is released, including a bottom and a top when it is positioned upright, the actuator wall (25) being situated at a bottom wall of the dispenser, with the bottom wall of the dispenser bearing, in its rest position and in its depressed position, against the actuator wall.

6. A fluid dispenser comprising:

a fluid reservoir of variable working volume, in which the reservoir fluid is protected from the air, a wall of the reservoir is an actuator wall that is axially movable down and up between a rest position and a depressed position, the movement of the wall causing the pressure in the reservoir to vary, the wall being situated at an end of the dispenser; and a dispenser orifice via which the fluid is dispensed, the orifice being provided with an outlet valve;

the actuator wall is in direct contact with the fluid in the reservoir; and the reservoir forms a slide cylinder in which there is engaged a follower piston that is configured to slide in a leaktight manner in the cylinder, wherein the actuator wall and the follower piston move along a common axis X, and the follower piston remains static with respect to the cylinder during dispensing and moves with respect to the cylinder when the pressure on the actuator wall is released, including a one-piece body that internally defines the fluid reservoir, the body being closed by a bottom wall that forms the actuator wall.

7. The fluid dispenser according to claim 6, in which the reservoir (10) is mainly formed by the bottom wall, the body, and the follower piston, the follower piston being positioned between the bottom wall and the dispenser orifice.

8. The fluid dispenser according to claim 7, in which the body forms a sleeve that is secured to the dispenser orifice, the follower piston forming a duct that is slidably engaged in leaktight manner in the sleeve, the reservoir thus communicating with the dispenser orifice via the duct and the sleeve.

9. A fluid dispenser comprising:

a fluid reservoir configured to have a variable working volume so as to protect fluid in the reservoir from air, a wall of the reservoir being an actuator wall movable between a rest position and a depressed position, the movement of the actuator wall causing pressure in the reservoir to vary; and a dispenser orifice through which the fluid is dispensed, the orifice comprising an outlet valve; and a follower piston;

the actuator wall is in direct contact with the fluid in the reservoir; and the reservoir defines a slide cylinder that engages the follower piston configured to slide in the slide cylinder in a leaktight manner from a first rest position defining a first volume of the reservoir to a second rest position defining a second volume of the reservoir, the second volume of reservoir volume smaller than the first volume of the reservoir, wherein the actuator wall and the follower piston move along a common axis X, and the follower piston remains static with respect to the slide cylinder during dispensing and moves with respect to the slide cylinder when the pressure on the actuator wall is released, wherein the follower piston comprises a connection duct that puts the reservoir in communication with the dispenser orifice.

10. The fluid dispenser according to claim 9, wherein dispenser orifice is located at an end of the dispenser other than an end at which the actuator wall is located.

11. The fluid dispenser according to claim 9, wherein dispenser orifice is located at an end of the dispenser opposite an end at which the actuator wall is located.

12. The fluid dispenser according to claim 9, wherein the actuator wall is located at an end of the dispenser.

13. The fluid dispenser according to claim 9, wherein the reservoir is made of a cylinder having one-piece integral construction that is closed at a bottom by the actuator wall with the follower piston disposed between the dispenser orifice and the actuator wall; and the follower piston comprising a duct slidably engaged in leaktight manner in an internal sleeve of the reservoir thereby communicating fluid with the dispenser orifice through the duct and the sleeve.

* * * * *